US006206235B1

(12) United States Patent
Green

(10) Patent No.: US 6,206,235 B1
(45) Date of Patent: Mar. 27, 2001

(54) CANDY DISPENSER

(76) Inventor: Daniel Green, 1 Laughing Lake, Ladue, MO (US) 63124

( * ) Notice: Subject to any disclaimer, the term of this patent is extended or adjusted under 35 U.S.C. 154(b) by 0 days.

(21) Appl. No.: 09/348,786

(22) Filed: Jul. 7, 1999

(51) Int. Cl.[7] ..... B65G 59/00; B65H 3/00; G07F 11/16

(52) U.S. Cl. ..... 221/251; 221/204; 221/205; 221/263; 221/293

(58) Field of Search ..... 221/168, 190, 221/204, 205, 227, 228, 235, 251, 252, 257, 263, 276, 288, 293

(56) References Cited

U.S. PATENT DOCUMENTS

| | | | | |
|---|---|---|---|---|
| 3,301,437 | * | 1/1967 | Faber | 221/202 X |
| 3,398,857 | * | 8/1968 | Alio | 221/190 X |
| 3,471,056 | * | 10/1969 | Kovac | 221/276 X |
| 3,493,145 | * | 2/1970 | Dessoy et al. | 221/204 X |
| 3,796,347 | * | 3/1974 | Hafner | 221/251 X |
| 3,845,882 | | 11/1974 | Hass . | |
| 4,117,956 | * | 10/1978 | von Schuckmann | 221/288 X |
| 4,295,579 | | 10/1981 | Haas . | |
| 4,415,098 | * | 11/1983 | Haas | 221/202 X |
| 4,564,124 | | 1/1986 | Burton . | |
| 5,048,720 | | 9/1991 | Hoke . | |
| 5,178,298 | | 1/1993 | Allina . | |
| 5,785,206 | | 7/1998 | Chan . | |

* cited by examiner

*Primary Examiner*—Christopher P. Ellis
*Assistant Examiner*—Gene O. Crawford
(74) *Attorney, Agent, or Firm*—Polster, Lieder, Woodruff & Lucchesi

(57) ABSTRACT

A candy dispenser includes a container defining a chamber adapted to hold a plurality of pieces of candy in a random fashion. The container has sides, a top, and a bottom which define the chamber. A dispensing tube extends along one side of the container. An opening in the container places the chamber in communication with the dispensing tube. The opening is sized to admit a piece of candy from the chamber to the dispensing tube. A leaf spring is mounted to the bottom of the container. The spring has a spring arm which closes the bottom of the dispensing tube and an upwardly extending finger on the spring arm which is received in the dispensing tube. A plunger associated with the dispenser moves the leaf spring from a relaxed state in which the spring finger is in the dispensing tube and closes the opening to a primed state in which the spring arm is urged away from the dispensing tube a distance sufficient for the spring finger to clear the opening to allow a piece of candy to enter the dispensing tube. Upon release of the spring, the candy is urged up and out of the dispensing tube.

10 Claims, 3 Drawing Sheets

CANDY DISPENSER

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates to candy dispensers, and in particular, to a hand-held dispenser which can be operated single handedly to dispense individual pieces of candy.

Hand held candy dispensers, such as for PEZ® or TIC-TACS® are well known. Dispensers, such as the TIC-TACS dispensers, are basically a container with an openable lid. These dispensers require the use of two hands to open; one hand to hold the container and the other to open the lid. Some people may be able to hold the container in one hand, and using the thumb of that hand, open the lid. Once the container is opened, the container must be tipped over to dispense the candy. Often, more than one piece of candy is dispensed at a time.

Dispensers, such as PEZ dispensers, include a chamber which holds the candy, a spring biased mechanism which urges the candies up toward the top of the dispenser, and a pusher, which, when operated, pushes the candies out of the dispenser. Although these can be easily operated with one hand, they only work well with candies that can be stacked one on top of the other. They do not work well with candies, such as small round candies, which are held in a random fashion in the dispenser.

BRIEF SUMMARY OF THE INVENTION

Briefly stated, my new candy dispenser includes a container defining a chamber adapted to hold a plurality of pieces of candy in a random fashion. The container has sides, a top, and a bottom which define the chamber. A dispensing tube extends along one side of the container. An opening between the container and the dispensing tube places the chamber in communication with the dispensing tube, near the bottom of the dispensing tube. The opening is sized to admit a single piece of candy from the chamber to the dispensing tube. A leaf spring is mounted to the bottom of the container. The spring has a spring arm which closes the bottom of the dispensing tube and an upwardly extending finger on the spring arm which is received in the dispensing tube. A plunger moves the leaf spring between a relaxed state and a primed state. In the relaxed state, the spring finger is in the dispensing tube and closes the opening between the chamber. In the primed state, the spring arm is urged away from the dispensing tube a distance sufficient for the spring finger to clear the opening to allow a piece of candy to enter the dispensing tube. Upon release of the plunger, the spring returns to its relaxed condition, and the candy is urged up and out of the dispensing tube.

In one embodiment, the plunger arm slides in a channel formed on an inner surface of the container wall. The plunger includes a thumb portion and a plunger arm. At least one finger extends down from a bottom of the dispenser arm. The dispenser container has an opening in the bottom through which the plunger finger extends. The plunger finger contacts the spring arm to move the spring arm from its relaxed state to its primed state when the plunger is depressed. The bottom of the plunger arm defines a knife-edge which closes the opening when the plunger is depressed.

In a second embodiment, the candy dispenser includes a pair of guide tubes adjacent the dispensing tube. The plunger arm is made of two arms or rods which extend through the guide tubes. The plunger thumb portion extends between, and connects, the plunger arms. The spring arm is sized to extend below the guide tubes. The plunger arms are of a sufficient length to move the spring from its relaxed state to its primed state.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes what I presently believe to be the best mode of carrying out the invention.

Figure 3:
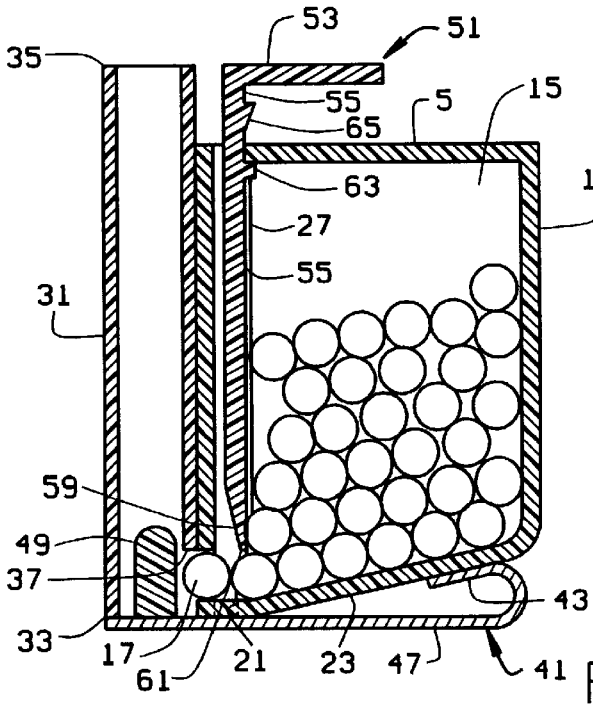
FIG. 3 is a cross-sectional view taken along line 3—3 of FIG. 1.
Figure 4:
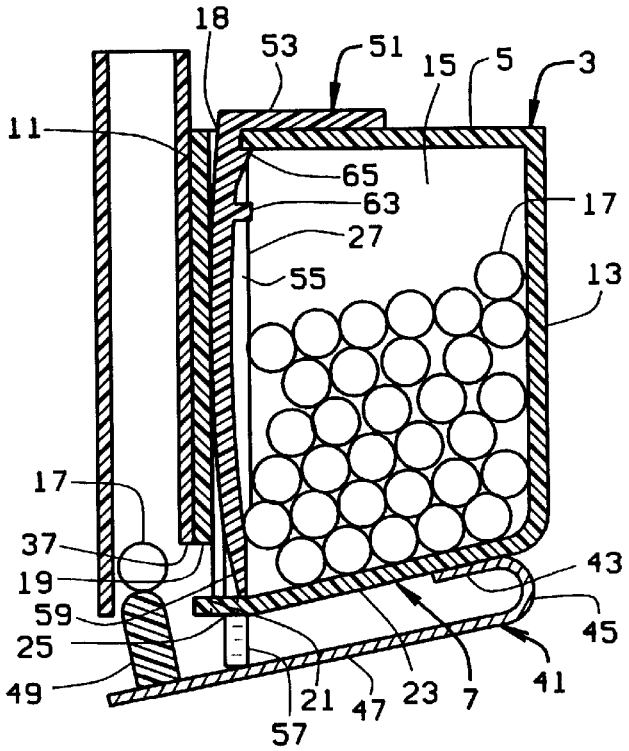
FIG. 4 is a view similar to that of FIG. 3, but with a piece of candy in a dispensing tube ready to be dispensed from the dispenser.
Figure 5:
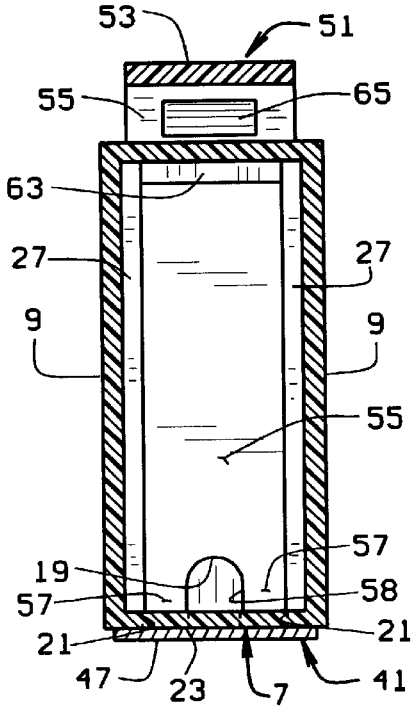
FIG. 5 is a cross-sectional view taken along line 5—5 of FIG. 1.
Figure 6:
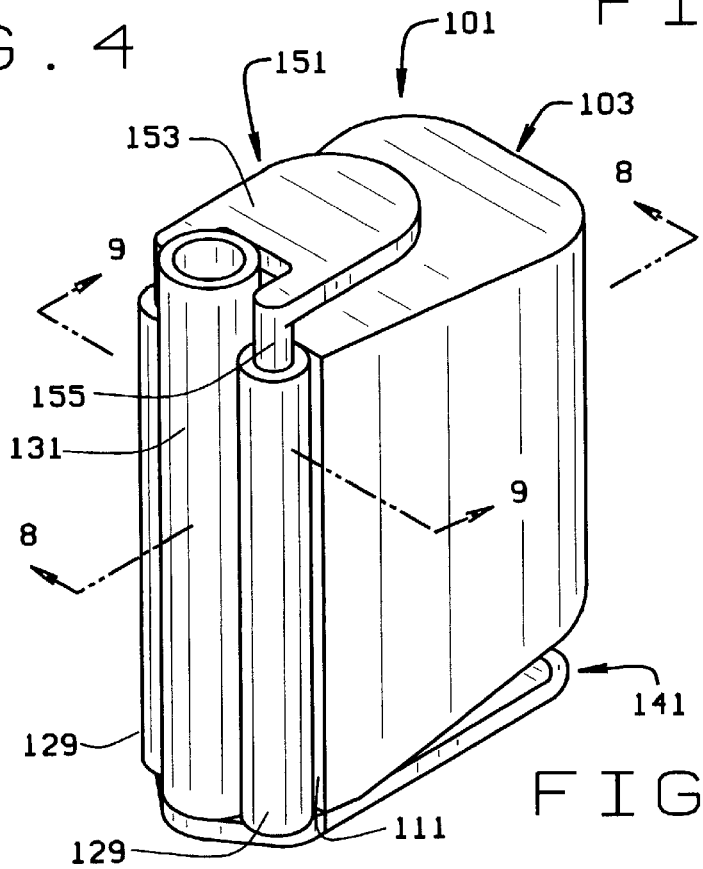
FIG. 6 is a perspective view of a second embodiment of the candy dispenser.
Figure 7:
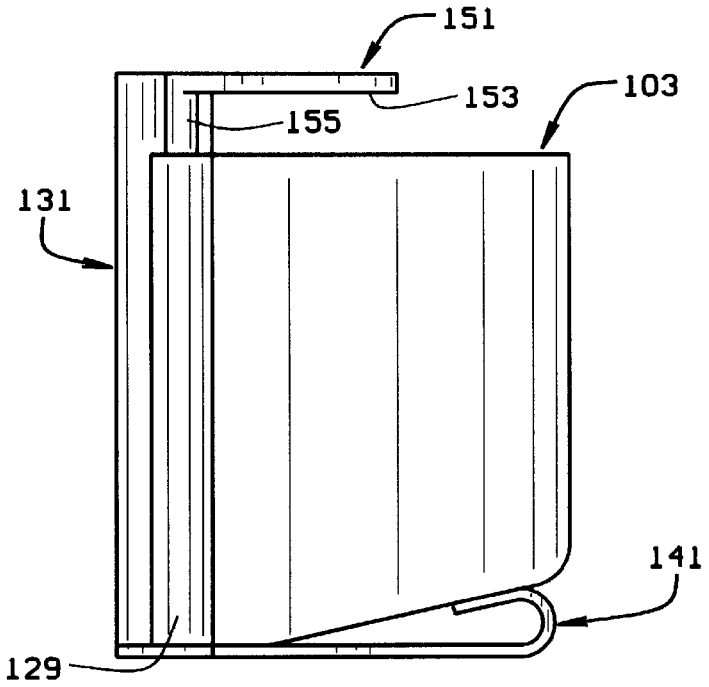
FIG. 7 is a side elevational view of the candy dispenser of FIG. 6.
Figure 9:
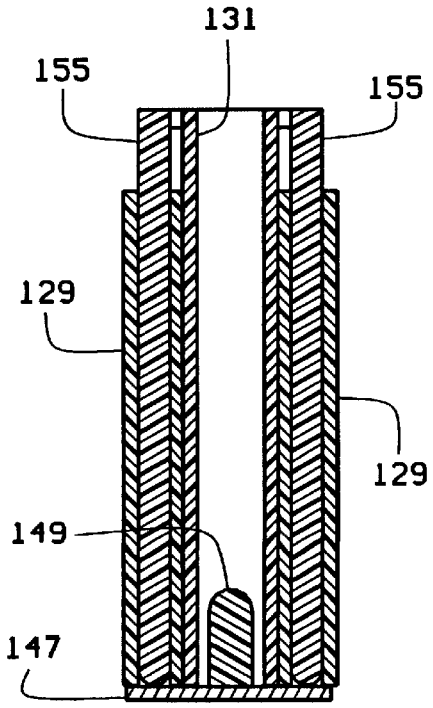
FIG. 9 is a cross-sectional view taken along line 9—9 of FIG. 6.
Figure 8:
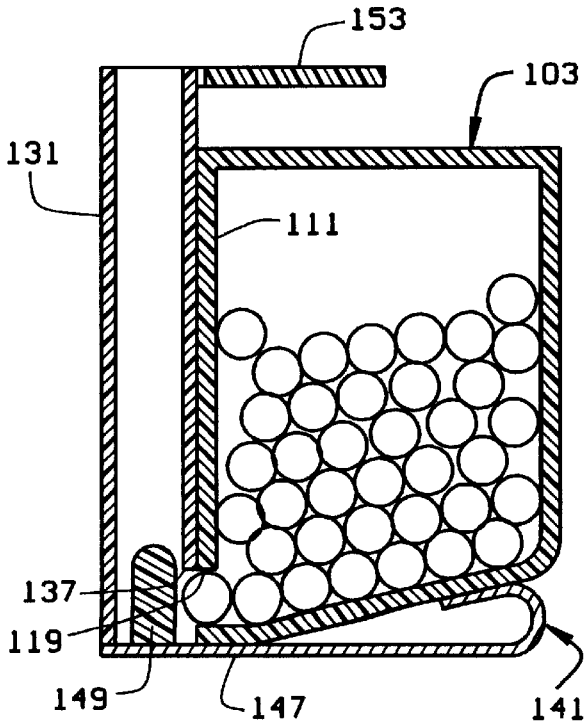
FIG. 8 is a cross-sectional view taken along line 8—8 of FIG. 6.

A first embodiment of a candy dispenser of the present invention is shown in FIGS. 1–5. The candy dispenser 1 includes a container 3 having a top 5, a bottom 7, sides 9, a front 11, and a back 13 defining a chamber 15 in which pieces of candy 17 are housed. As seen in FIGS. 3 and 4, the candies 17 are randomly arranged in the chamber 15. That is, they are not stacked or otherwise arranged in any special order. The container 3 has a slot 17 in its top wall 5 adjacent the front wall 11 and a opening 19 in the front wall 11 at the bottom of the front wall. Additionally, a pair of spaced apart openings 21 are formed in the bottom wall 7 on opposite sides of the exit opening 19. As best seen in FIGS. 3 and 4, the bottom wall 7 includes a forwardly sloping portion 23 which leads to an essentially flat forward portion 25 near the front wall 1. The sloping portion 23 urges the candies 7 toward the exit opening 19 by way of gravity. The openings 21 are formed in the floor flat portion 25. Lastly, the container 3 includes a pair of guide rails 27 which extend inwardly from the sidewalls 9. The rails 27 are spaced rearwardly from the front wall 11.

A dispensing tube 31 is mounted to the container front wall 11. The tube 31 is open at its bottom 33 and at its top 35. The dispensing tube bottom 33 is flush with the container bottom wall portion 25 and the bottom of the front wall 11. The top 35 of the dispensing tube 31 extends above the container top 5. The dispensing tube 31 includes an entrance opening 37 at its bottom that is aligned with the exit opening 19 in the container front wall 11 to place the chamber 15 in communication with the dispensing tube 31. The openings 19 and 37 are preferably the same size, and are sized to admit a single piece of candy 17 at a time from the chamber 15 to the dispensing tube 31. Although the dispensing tube 31 is shown as a separate piece which is glued or welded to the container front wall 11, the container 3 with the tube 31 can be formed as a unitary, one-piece assembly. In this case, the openings 19 and 37 would be one and the same.

A leaf spring 41 is mounted to the bottom of the container 3. The leaf spring 41 includes a mounting portion 43 which is glued, welded, or otherwise adhered to the container bottom 7 near the container back wall 13. A curved portion 45 extends from the back of the mounting portion 43 and defines an arc of about 180°. A spring leg 47 extends forwardly from the curved portion 45 to a position beneath the dispensing tube bottom 33. A finger 49 extends up from the spring leg 47 slightly rearwardly of the free end of the leg 47. The finger 49 is received in the bottom of the dispensing tube 31. It is sized to close the openings 37 and 19 between the dispensing tube 31 and the chamber 15 when the spring is in its relaxed position, as seen in FIG. 3. The free end of the spring leg 47 is sized to close the bottom of the dispensing tube 31 when in its relaxed position. The curved portion 45 of the spring 41 is sized and shaped so that the spring leg 47 will be substantially parallel to the container top wall 5 when the spring is relaxed. Thus, when the spring is relaxed, the spring leg 47 forms a bottom of the candy dispenser 1 upon which the candy dispenser 1 can sit. Stated differently, the spring leg 47 provides a flat surface which will allow the dispenser 1 to stand upright when placed on a flat surface.

The spring 41 is preferably made from a flexible and elastic plastic. If made from such a plastic, the spring 41 can be formed integrally with the container back wall 13. In such a case, the mounting portion 43 would be eliminated, and instead, there would be a back portion extending down from the back wall which would lead into the curved portion 45. Additionally, if the spring 41 is made from plastic, then the spring finger 49 could be formed integrally with the spring 41. Alternatively, the spring 41 can be made from metal, or any other material which will flex or spring between a relaxed state and a primed state.

A plunger 51 is slidably received in the channels of the rails 27 to dispense candy. The plunger 51 includes a thumb portion 53 and a plunger arm 55. The plunger arm 55 is preferably slightly flexible. The plunger arm 55 extends through the slot 17 in the container top 5 and slides in the channels between the rails 27 and the front wall 11. As seen in FIGS. 3 and 4, the slot 17 is wider than the plunger arm 55. Thus, the plunger arm 55 can move forwardly and rearwardly in the slot 17. A pair of spaced-apart fingers 57 extends down from opposite sides of the bottom 59 of the plunger arm 55. The fingers 57 are aligned with holes 21 in the container bottom 7, and are sized to be pushed through the container bottom holes 21. As can be appreciated, the fingers 57 define an opening 58 between them which surrounds the opening 19 in the container front wall 11. Additionally, as seen in FIGS. 3 and 4, the front surface of the plunger arm 55 is sloped, as at 61, so that the bottom 59 of the plunger arm 53 forms a knife-edge. A stop finger 63 is formed on the plunger arm 55 below the container top 5 and a cocking finger 65 is formed on the plunger arm 55 to be above the container top 5. The stop finger 63 is spaced from the thumb portion 53 at least a distance approximately equal to the distance between the bottom 61 of the plunger arm 55 and the bottom of the fingers 57. The cocking finger 65 is positioned below the thumb portion 53 a distance approximately equal to, or slightly greater than, the length of the fingers 57.

In operation, when the dispenser 1 is not in use it is in the position shown in FIG. 3. The spring 47 is relaxed; the finger 49 extends into the dispensing tube 31 to close the opening 37 between the dispensing tube 31 and the chamber 15, and the plunger 51 is elevated. A piece of candy 17 is situated in the openings 19 and 37 ready to enter the dispensing tube 31. To dispense the candy 17, the plunger 51 is pressed down. When pressed down, the plunger fingers 57 will extend through the holes 21 in the container bottom 7 to push the spring leg 47 away from the container bottom. The plunger fingers 57 and spring finger 49 are sized, so that when the plunger 51 is fully depressed, the tip of the spring finger 49 will be approximately level with the bottom of the openings 19 and 37. Thus, the spring finger 49 will be clear of the openings 19 and 37 so that a piece of candy 17 can move into the dispensing tube 31. The depressing of the plunger will also cause the knife-edge 59 of the plunger arm 55 to urge the candy piece 17 in the opening 19 into the dispensing tube 31. The arm 55, when fully depressed will close the opening 19 from within the chamber 15, so that only one piece of candy can enter the tube at a time. Additionally, pressing down of the plunger 51 causes the plunger arm 55 to bend slightly, as seen in FIG. 4, so that the top edge of the cocking finger 65 engages the underside of the container top 5. When the plunger 51 is fully depressed and in its cocked position, the dispenser will appear as seen in FIG. 4. The plunger 51 can then be released by pushing the plunger 51 forwardly. This will cause the cocking finger 65 to come out from under the container top 5 and to be in the slot 17. The spring leg 47 will then be released to spring back to its relaxed position. In doing so, it will urge the candy 17 up and out of the dispensing tube. At the same time, the spring leg 47 will push the plunger 51 back to its elevated position. The stop finger 63 will engage the underside of the container top to prevent the plunger 55 from exiting the container 3.

Thus, in sum, the dispenser 1 is operated simply by pressing down on the plunger 51 and then pushing the plunger forward to release the plunger. The dispenser 1 is sized so that it can be held in the user's hand. It can thus be operated with one hand. The material from which the spring 41 is made preferably has a spring factor, such that upon depressing the plunger, the spring 41 will have sufficient potential energy to urge the candy 17 just above the top of the dispensing tube 31. Thus, the candy 17 which is urged out of the tube 31 will not "fly" out of the dispensing tube 31.

A second embodiment of the dispenser is shown in FIGS. 6–9. The dispenser 101 is substantially similar to the dispenser 1 of FIG. 1. Only the plunger 151 has been altered. The dispenser 101 includes a container 103 substantially identical to the container 3. However, because the plunger 151 is different, the container 151 does not include the rails 27 on the inside of the container front wall 111. The dispensing tube 131 is identical to the dispensing tube 31, and the spring 141 is substantially identical to the spring 41.

The dispenser 101 includes a pair of guide tubes 129 on opposite sides of the dispensing tube 131. The guide tubes 129 are open at both ends and extend the length of the container front wall 111. When the spring 141 is relaxed, the spring arm 147 closes the bottom of the guide tubes 129 as well as the bottom of the dispensing tube 131. The plunger 151 includes a pair of arms or rods 155 which are joined at their tops by a thumb portion 153. The plunger arms 155 are longer than the guide tubes 129 and are about equal in length to the dispensing tube 131. The dispenser 101 operates in the same manner as the dispenser 1. When the plunger 151 is depressed, the plunger arms 155 push the spring arm 147 down so that the spring finger 149 will clear the openings 119 and 137 in the container front wall 111 and the dispensing tube 131, respectively. A piece of candy can then enter the dispensing tube. When the plunger 151 is released, the spring action of the spring 141 will urge the piece of candy in the tube 131 up and out of the tube.

In the dispenser 101, the dispensing tube 131 and the guide tubes 129 can be formed with the container 103, such that the container 103, the dispensing tube 131, and the guide tubes 129 form a unitary, one-piece assembly. Additionally, if practical, the spring 141 can also be integrally molded with the container 103, as noted above in conjunction with the dispenser 1.

Figure 1:
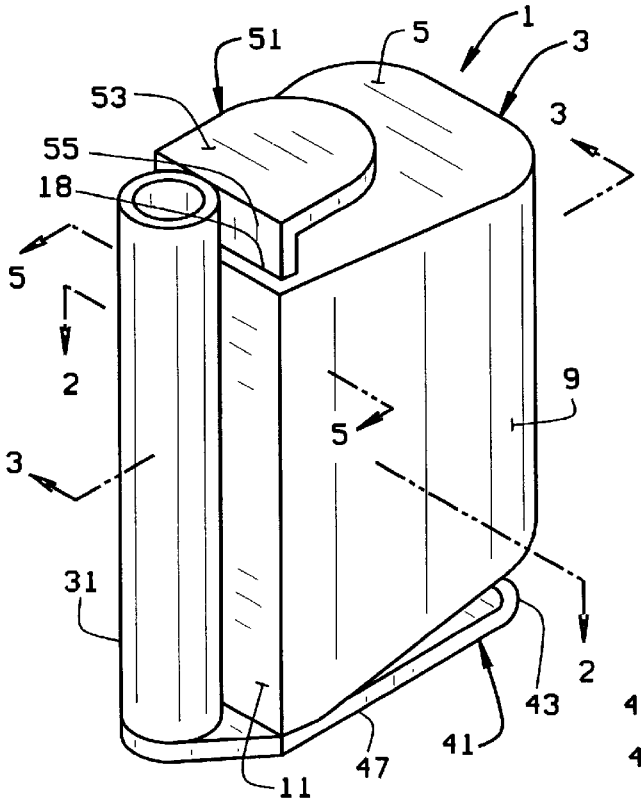
FIG. 1 is a perspective view of a first embodiment of a candy dispenser of the present invention.
Figure 2:
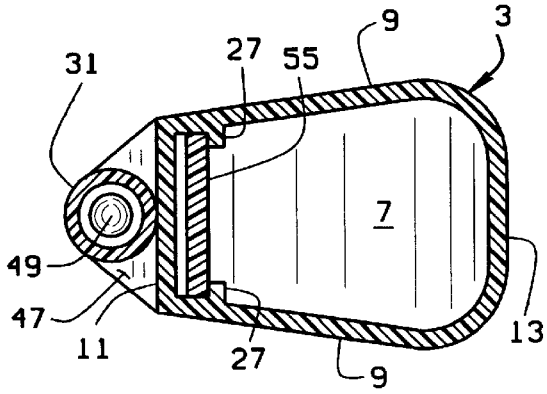
FIG. 2 is a cross-sectional view taken along line 2—2 of FIG. 1.

As various changes could be made in the above constructions without departing from the scope of the invention, it is intended that all matter contained in the above description or shown in the accompanying drawings shall be interpreted as illustrative and not in a limiting sense. For example, the cocking finger 65 of the dispenser 1 could be eliminated. The dispenser would then be operated by pressing down on, and then releasing, the plunger 51. It would thus operate similarly to the dispenser 101 of FIG. 6. The bottom of the container need not be sloped. Other types of leaf springs can be used. For example, if the container bottom were flat, rather than sloped, the spring 41 could be a flat leaf spring which would extend along the bottom of the container. In the embodiment of FIG. 1, the plunger 51 could be eliminated. Instead, the spring arm 47 would extend beyond the dispensing tube 31. In this way, the dispenser would be operated by pulling down on the spring arm 47 to allow the candy 17 into the dispensing tube. The spring arm 47 would then be released to dispense the candy from the tube 31. The spring could also have other shapes. For example, rather than the substantially C-shaped spring shown in the drawings, the spring could be generally S-shaped. Although the dispensing tubes 31, 131 are shown to be opened, they can have a floor with an hole through which the fingers 49, 149 enter the tube. Such a hole would be sized such that the piece of candy would sit in the hole after it enters the dispensing tube. This would center the piece of candy with respect to the spring finger 49, 149. These examples are merely illustrative.

What is claimed is:

1. A candy dispenser comprising:

a container defining a chamber adapted to hold a plurality of pieces of candy in a random fashion; the container having sides, a top, and a bottom which define the chamber;

a hollow dispensing tube extending along one side of the container, the dispensing tube being open at a top thereof and having an opening in a bottom thereof;

an opening between the container and the dispensing tube to place the container chamber in communication with the dispensing tube; the opening being sized to admit a piece of candy from the chamber to the dispensing tube; and a leaf spring on the bottom of the container; the spring having a spring arm which closes the opening in the bottom of the dispensing tube and an upwardly extending finger on the spring arm which extends through the dispensing tube bottom opening to be received in the dispensing tube; the leaf spring being movable from a relaxed state in which the spring finger is in the dispensing tube and closes the opening between the chamber and the dispensing tube to a primed state in which the spring arm is urged away from the dispensing tube a distance sufficient for the spring finger to clear the opening to allow a piece of candy to enter the dispensing tube; whereby, upon release of the spring, the spring finger contacts the candy and imparts sufficient force to the candy to urge the candy up and out of the dispensing tube.

2. The candy dispenser of claim 1 wherein the spring includes a mounting portion which is adhered to the bottom of the container, a transition portion extending from the mounting portion, the spring arm extending from the transition portion.

3. The candy dispenser of claim 1 wherein the opening between the chamber and the dispensing tube is sized to admit a single piece of candy into the dispensing tube.

4. The candy dispenser of claim 1 including a plunger; the plunger being operable to move the spring from its relaxed state to its primed state.

5. The candy dispenser of claim 4, wherein the plunger slides in a channel formed in an inner surface of the container wall.

6. The candy dispenser of claim 1 wherein at least a portion of the container bottom is sloped towards the container opening.

7. The candy dispenser of claim 6 wherein the container opening is near the bottom of the container.

8. A candy dispenser comprising:

a container defining a chamber adapted to hold a plurality of pieces of candy; the container having sides, a top, and a bottom which define the chamber;

a dispensing tube extending along one side of the container, the dispensing tube being open at a top and a bottom thereof;

an opening in a side of the container to place the chamber in communication with the dispensing tube; the opening being sized to admit a piece of candy from the chamber to the dispensing tube;

a leaf spring on the bottom of the container; the spring having a spring arm which closes the bottom of the dispensing tube and an upwardly extending finger on the spring arm which is received in the dispensing tube; the leaf spring being movable from a relaxed state in which the spring finger is in the dispensing tube and closes the opening between the chamber and the dispensing tube to a primed state in which the spring arm is urged away from the dispensing tube a distance sufficient for the spring finger to clear the opening to allow a piece of candy to enter the dispensing tube; whereby, upon release of the spring, the candy is urged up and out of the dispensing tube; and a plunger; the plunger being operable to move the spring from its relaxed state to its primed state; the plunger sliding in a channel formed in an inner surface of the container wall; the plunger including at least one finger extending down from a bottom of the plunger; the dispenser container having an opening in the bottom through which the plunger finger extends; the plunger finger contacting the spring arm to move the spring arm from its relaxed state to its primed state when the plunger is depressed.

9. A candy dispenser comprising:

a container defining a chamber adapted to hold a plurality of pieces of candy; the container having sides, a top, and a bottom which define the chamber;

a dispensing tube extending along one side of the container, the dispensing tube being open at a top and a bottom thereof;

an opening in a side of the container to place the chamber in communication with the dispensing tube; the opening being sized to admit a piece of candy from the chamber to the dispensing tube; and a leaf spring on the bottom of the container; the spring having a spring arm which closes the bottom of the dispensing tube and an upwardly extending finger on the spring arm which is received in the dispensing tube; the leaf spring being movable from a relaxed state in which the spring finger is in the dispensing tube and closes the opening between the chamber and the dispensing tube to a primed state in which the spring arm is urged away from the dispensing tube a distance sufficient for the spring finger to clear the opening to allow a piece of candy to enter the dispensing tube; whereby, upon release of the spring, the candy is urged up and out of the dispensing tube; and a plunger; the plunger being operable to move the spring from its relaxed state to its primed state; the plunger sliding in a channel formed in an inner surface of the container wall and having a bottom; the bottom of the plunger defining a knife edge which closes the opening when the plunger is depressed.

10. A candy dispenser comprising:

a container defining a chamber adapted to hold a plurality of pieces of candy; the container having sides, a top, and a bottom which define the chamber;

a dispensing tube extending along one side of the container, the dispensing tube being open at a top and a bottom thereof;

a pair of guide tubes;

an opening in a side of the container to place the chamber in communication with the dispensing tube; the opening being sized to admit a piece of candy from the chamber to the dispensing tube; and a leaf spring on the bottom of the container; the spring having a spring arm which closes the bottom of the dispensing tube and an upwardly extending finger on the spring arm which is received in the dispensing tube; the leaf spring being movable from a relaxed state in which the spring finger is in the dispensing tube and closes the opening between the chamber and the dispensing tube to a primed state in which the spring arm is urged away from the dispensing tube a distance sufficient for the spring finger to clear the opening to allow a piece of candy to enter the dispensing tube; whereby, upon release of the spring, the candy is urged up and out of the dispensing tube; and a plunger; the plunger being operable to move the spring from its relaxed state to its primed state; the plunger including two arms which extend through the guide tubes; the plunger arms being connected by a thumb portion; the spring arm being sized to extend below the guide tubes; the plunger arms being of a sufficient length to move the spring from its relaxed state to its primed state.

* * * * *

UNITED STATES PATENT AND TRADEMARK OFFICE

CERTIFICATE OF CORRECTION

PATENT NO. : 6,206,235 B1
DATED : March 27, 2001
INVENTOR(S) : Green

It is certified that error appears in the above-identified patent and that said Letters Patent is hereby corrected as shown below:

Column 2,
Line 53, the number "17" should read -- 18 --
Line 60, "1" should read -- 11 --

Signed and Sealed this

Thirtieth Day of October, 2001

*Attest:*

Nicholas P. Godici

NICHOLAS P. GODICI
*Acting Director of the United States Patent and Trademark Office*

*Attesting Officer*